US006178893B1

(12) United States Patent
Pease

(10) Patent No.: US 6,178,893 B1
(45) Date of Patent: Jan. 30, 2001

(54) ADJUSTABLE HINGED DERAIL

(75) Inventor: Ronald Pease, Hickory Hills, IL (US)

(73) Assignee: Western-Cullen-Hayes, Inc., Chicago, IL (US)

( * ) Notice: Under 35 U.S.C. 154(b), the term of this patent shall be extended for 0 days.

(21) Appl. No.: 09/233,593

(22) Filed: Jan. 19, 1999

(51) Int. Cl.[7] ..... B61F 19/00

(52) U.S. Cl. ..... 104/261; 104/262; 104/265; 104/271; 246/163; 269/97

(58) Field of Search ..... 246/163; 104/261, 104/262, 263, 264, 265, 266, 268, 271; 269/97, 143, 147, 249

(56) References Cited

U.S. PATENT DOCUMENTS 1,079,990 * 12/1913 McEvoy ..... 246/163
1,109,007 * 9/1914 Nibbe ..... 246/163
1,242,847 * 10/1917 Packer ..... 246/163
1,464,606 * 8/1923 Hayes ..... 246/163
1,464,607 * 8/1923 Hayes ..... 246/163
1,627,092 * 5/1927 Hayes ..... 246/163
2,829,246 4/1958 Hayes .
4,165,060 8/1979 Meyer .

* cited by examiner

*Primary Examiner*—Sherman Basinger
*Assistant Examiner*—Frantz Jules
(74) *Attorney, Agent, or Firm*—Banner & Witcoff, Ltd.

(57) ABSTRACT

A hinged derail is provided with an adjustment assembly for adjusting the position of the hinge pin relative to the rail. The hinged derail is adjustable to provide for proper alignment of the deflecting block with the top surface of a rail for a variety of rail heights. In a preferred embodiment, the adjustment assembly includes a pair of rotatable adjustment flanges which support the hinge pin in an eccentric fashion. Rotation of the adjustment flanges changes the vertical position of the hinge pin. In accordance with another aspect of the invention, an actuating assembly is provided for operatively associating a power actuator with the derail shoe.

14 Claims, 8 Drawing Sheets

ADJUSTABLE HINGED DERAIL

BACKGROUND OF THE INVENTION

This invention relates generally to safety implements for railed vehicles. Specifically, the invention relates to hinged derailing devices which may be selectively deployed onto a rail for engaging and derailing wheels of railed vehicles.

Derails are safety implements that are placed on a rail to prevent or limit unintended movement of a railed vehicle. They are used extensively in the railroad industry as a means for preventing injury to personnel and damage to property. Typical derails are configured to be manually or automatically movable from a retracted position, in which a wedge-like deflecting block is disposed adjacent a rail, to a deployed position, in which the deflecting block is disposed on top of and aligned with the rail to engage and deflect an oncoming wheel.

Hinged derails, which include a deflecting block mounted on a derail shoe adapted to pivot about a pivot axis, usually defined by a hinge pin, relative to a base, are known in the art. Such derail configurations are disclosed, for example, in U.S. Pat. No. 1,627,094 to Hayes. In operation, the derail shoe is pivoted from its retracted position to its deployed position, where it is aligned with the rail. Proper alignment requires not only lateral alignment of the deflecting block with the rail, but also horizontal alignment in which the bottom surface of the deflecting block is substantially horizontal and supported on an upper surface of the rail. Proper alignment of the deflecting block is important for the derailing device to function safely.

There are a number of different rail sizes in existence and use today. These usually range from 5-inches to 7.5-inches. The variance in rail sizes presents a problem for adapting prior art hinged derails to different rail environments. This difficulty arises because the pivot axis of prior art hinged derails is fixed relative to the rail height. Thus, in order to obtain the proper alignment of the deflecting block of prior art hinged derails for a given rail size, the derail must be constructed according to particular dimensions applicable to that particular rail size. Moreover, shimming or other modifications to the rail system are frequently required to obtain proper derail block alignment with prior art hinged derails. Accordingly, a number of different derailing device configurations are required in order to accommodate the variety of rail sizes in existence today. This results in significant manufacturing cost and effort. Thus, there remains a need for a hinged derail that is easily adaptable to a variety of rail sizes.

An additional problem with prior art hinged derails is that actuating systems for are subjected to rather large forces as the rather massive derail block must be lifted using a lever-like arrangement. There is thus an additional need for an actuating system which is capable of repeated and dependable operation under the stresses created by these large forces.

SUMMARY OF THE INVENTION

The aforementioned problems and others are solved by the present invention which provides a hinged derail in which the position of the pivot axis is adjustable relative to the rail height. In a preferred embodiment, the invention provides a pair of adjustment flanges supporting a hinge pin at opposite ends and which are rotatably adjustable to a number of positions relative to the base. The hinge pin is eccentrically mounted on the adjustment flanges. As the adjustment flanges are rotated, the vertical position of the pivot axis relative to the rail may be adjusted. The base of the hinged derail is provided with various mounting holes to permit the base to be moved horizontally to maintain the hinge pin in a constant horizontal position and to permit alignment of the deflecting block relative to the rail. A primary advantage of the invention is that it provides a hinged derail which can be adjusted to permit the deflecting block of the derailing device to be properly aligned with rails of different heights.

The invention also provides an actuating system, including an actuating assembly which ensures dependable operation. The invention provides an actuating linkage which is guided within slotted guide plates associated with the base of the derailing device. The slotted guide plates cooperate with and guide a connecting pin which connects an actuating rod with a connecting link, shaped to transmit forces from the actuating rod to the derail shoe to move the derail shoe from its retracted position to its deployed position, or in the opposite direction.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are not to be construed as limiting the invention.

DETAILED DESCRIPTION OF THE INVENTION

Figure 1:
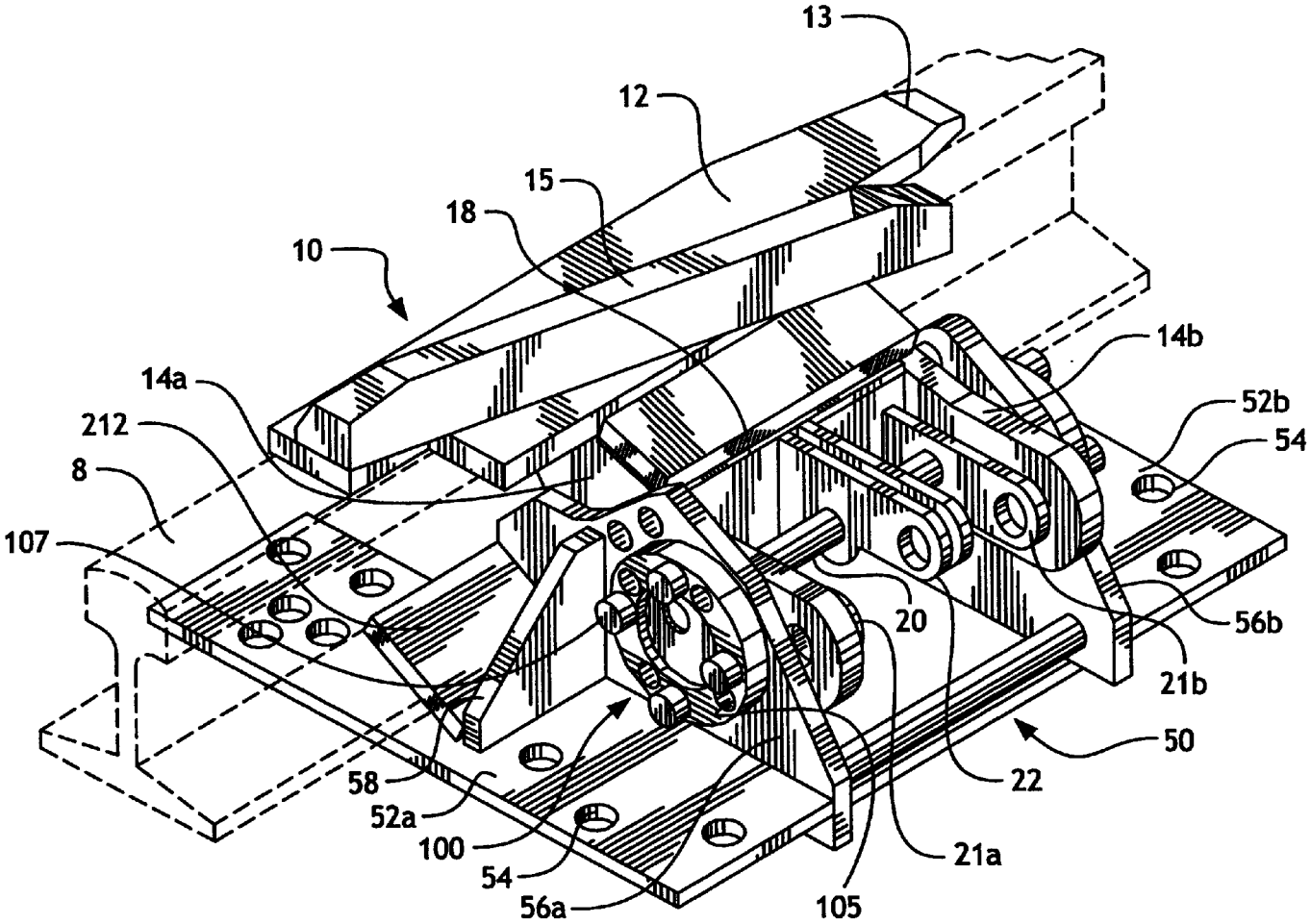
FIG. 1 is an isometric of an adjustable hinged derail according to a preferred embodiment of the present invention.

Referring to FIG. 1, an adjustable hinged derail according to a preferred embodiment of the invention generally comprises a derail shoe 10, which is pivotally associated with a base 50 through a hinge pin 20. The derail shoe 10 is adapted to engage a rail 8. An adjustment assembly 100, which will be described below, is provided on the base 50 to adjust the position of the hinge pin 20.

Figure 2:
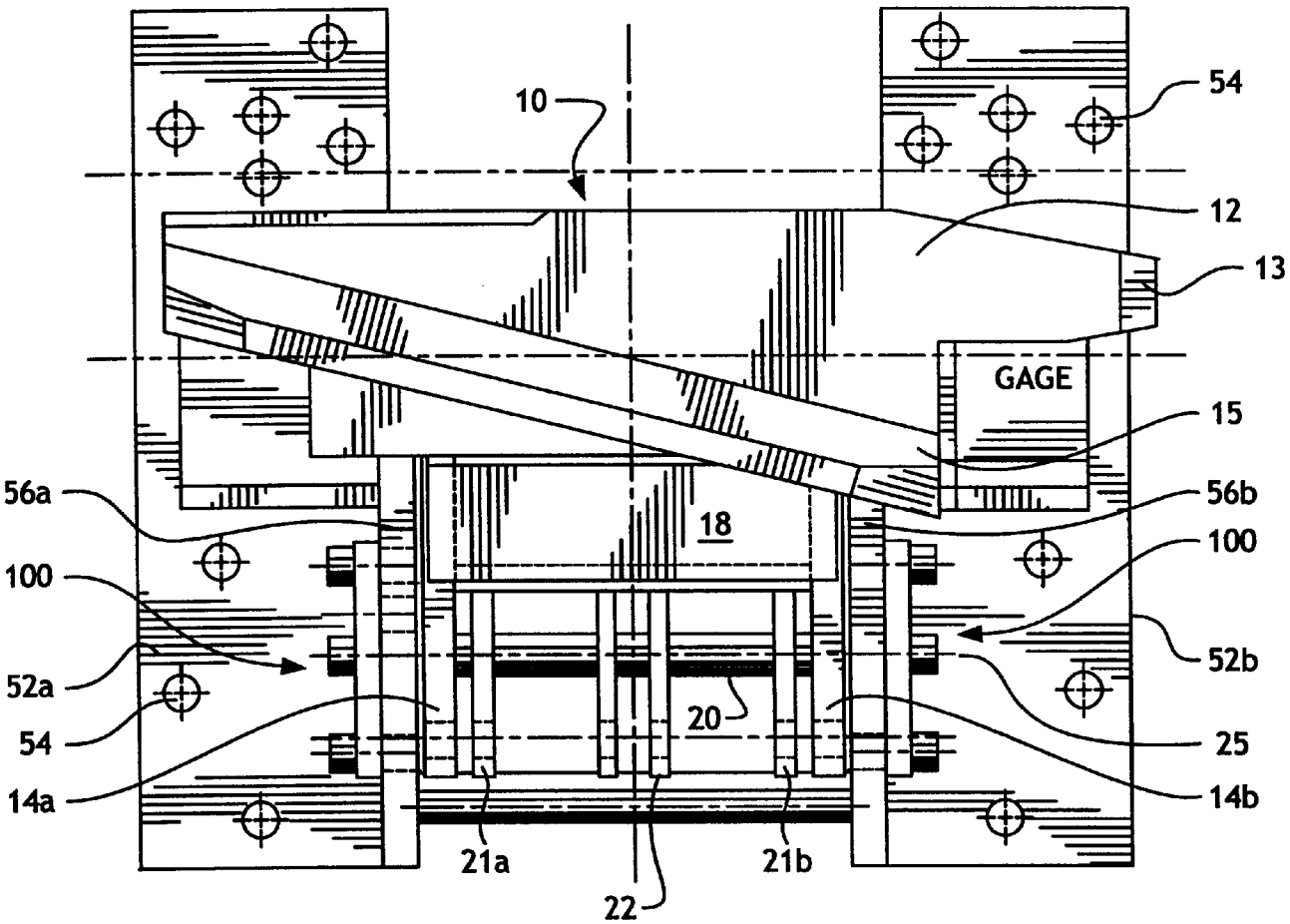
FIG. 2 is a top view of the adjustable hinged derail of FIG. 1.

Referring additionally to FIG. 2, the derail shoe 10 includes a deflecting block 12, including a wedge-shaped end 13 for engaging and lifting the oncoming wheel (not shown) of a railed vehicle and a deflecting bar 15, for deflecting the wheel laterally from the rail. Derail shoe 10 is generally of a welded steel plate construction. Extending from the deflecting block 12, and supporting it for pivotal movement with respect to the base 50, are two parallel hinge plates 14*a* and 14*b*, each having a hole (hidden in FIG. 1 and FIG. 2) through which hinge pin 20 extends. The hinge plates 14*a* and 14*b* are preferably connected and reinforced with one or more cross members 18. Hinge plates 14*a* and 14*b* are each provided with a respective indicator connecting lug 21*a* and 21*b* for operatively connecting derail position-monitoring or position-indicating equipment, such as a target stand or circuit controller to the derail shoe 10. Also extending from and fastened to derail shoe 10 is an actuating lug 22 for receiving a connecting pin to attach an actuator link assembly, which will be described below, to the derail shoe 10. Actuating lug 22 is provided with a hole through which hinge pin 20 extends.

Still referring to FIG. 1 and FIG. 2, the base 50 is comprised of a pair of mounting plates 52*a* and 52*b*, each having a series of mounting holes 54 therein for securing the mounting plates 52*a* and 52*b* in a fixed position relative to rail 8. Like the derail shoe 10, the base 50 is generally of a welded steel plate construction. Typically, the mounting plates 52*a* and 52*b* will be secured to wooden railroad ties (not shown) extending beneath the rail 8 via railroad spikes (not shown) driven through the mounting holes 54. As shown in FIG. 1, the mounting plates 52*a* and 52*b* extend beneath the rail 8 and would typically be situated on the top of railroad ties. Extending generally perpendicular to the mounting plates 52*a* and 52*b* are side plates 56*a* and 56*b*, respectively. Side plates 56*a* and 56*b* may include reinforcing brackets 58.

Figure 3:
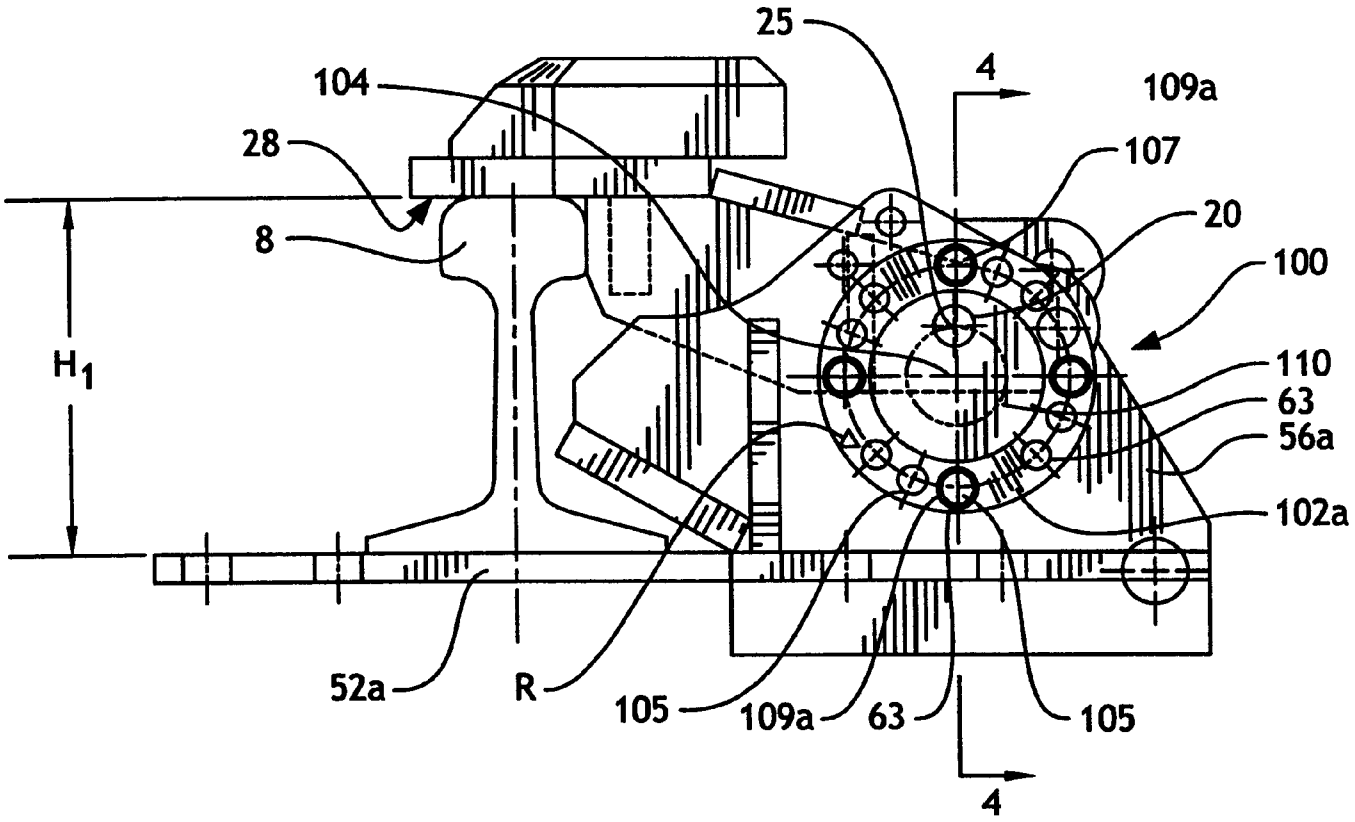
FIG. 3 is a side view of the adjustable hinged derail of FIG. 1 and FIG. 2.
Figure 4:
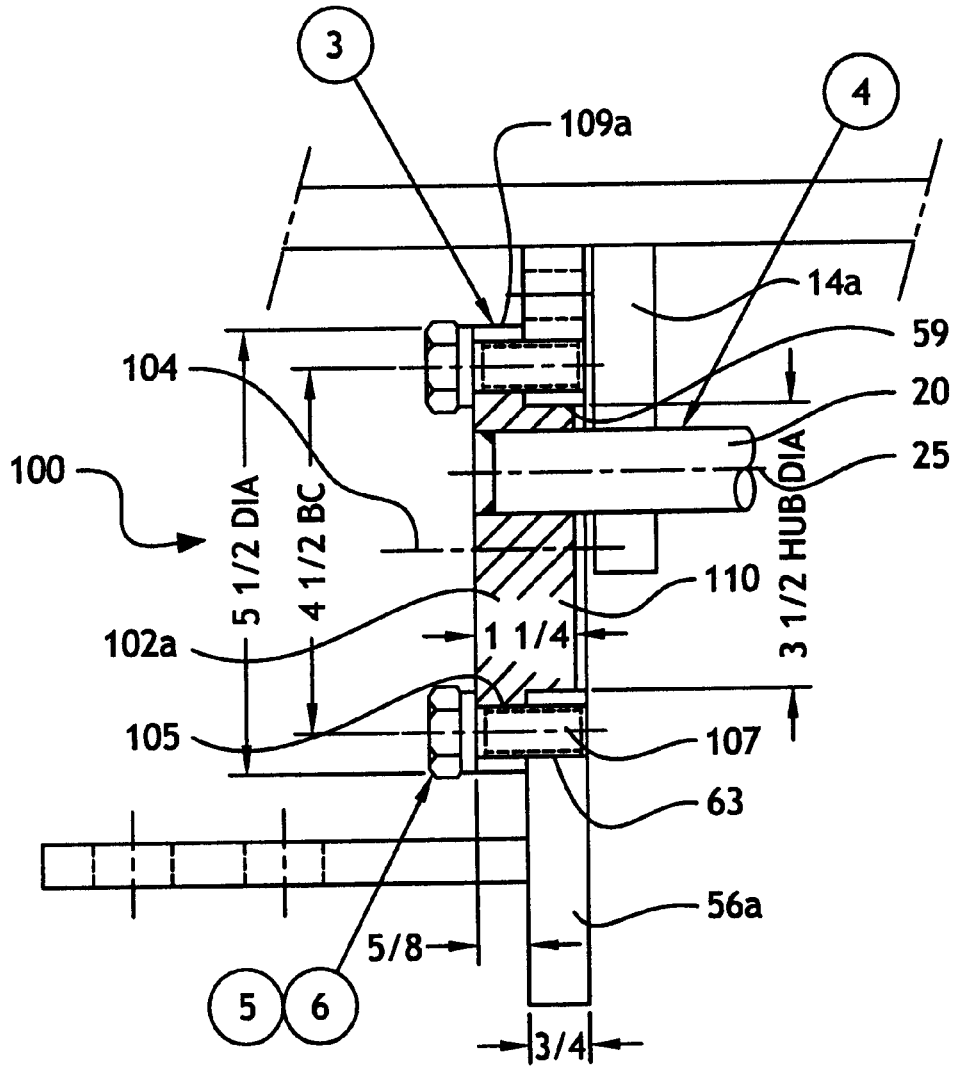
FIG. 4 is a cross-section taken along line 4—4 of FIG. 3.

Referring additionally to FIG. 3 and FIG. 4, each side plate 56*a* and 56*b* includes a circular journal 59 surrounded by a series of fastening holes 63, each preferably adapted to receive a threaded fastener 107 for securing the adjustment assembly 100 at fixed rotated positions. Adjustment assembly 100 is generally comprised of a pair of circular adjustment flanges 102*a* and 102*b* disposed at and supporting opposite ends of the hinge pin 20. Each adjustment flange 102*a* and 102*b* is provided with an annular shoulder 109 defining a reduced diameter portion 110 which is received in the journals 59 on the side plates 56*a* and 56*b*. Each adjustment flange 102*a* and 102*b* is provided with a series of through holes 105 on the annular for receiving threaded fasteners 107 to secure the adjustment flanges 102*a* and 102*b* at fixed rotational positions with respect to the side plates 56*a* and 56*b*.

In accordance with the invention, the adjustment flanges 102*a* and 102*b* support the hinge pin 20 in an eccentric fashion. Hinge pin 20 defines a pivot axis 25. Similarly, adjustment flanges 102*a* and 102*b* define an adjustment axis 104 about which they rotate as adjustment occurs. In accordance with a primary feature of the invention, the pivot axis 25 is offset from or eccentric with respect to the adjustment axis 104. Rotation of the adjustment flanges 102*a* and 102*b* will result in a change in the position of the hinge pin 20 and pivot axis 25. According to the invention, the number and spacing of the fastening holes 63 on the side plates 56*a* and 56*b*, and the number and spacing of the through holes 107 in the adjustment flanges are selected to provide adjustment intervals that will provide a number of hinge pin positions to accommodate an expected like number of different rail heights. A reference indicator R may be placed on the adjustment flanges 102*a* and 102*b*, and appropriate indicia on the side plates 56*a* and 56*b* to indicate adjustment positions for various rail sizes. It will therefore be recognized that the adjustment flanges 102*a* and 102*b* and the structure that cooperates with these elements provide a pivot adjusting means for adjusting the position of the pivot axis 25.

FIGS. 1–4, described above, illustrate a derail device according to a preferred embodiment of the invention adjusted for a rail height $H_1$ corresponding to the largest expected rail size for which the derailing device, according to the preferred embodiment described above, would be used. As best seen in FIG. 3, the hinge pin 20 and pivot axis 25 are disposed in the extreme vertical position and reference indicator R is oriented at approximately 100-degrees counterclockwise from vertical.

Figure 5:
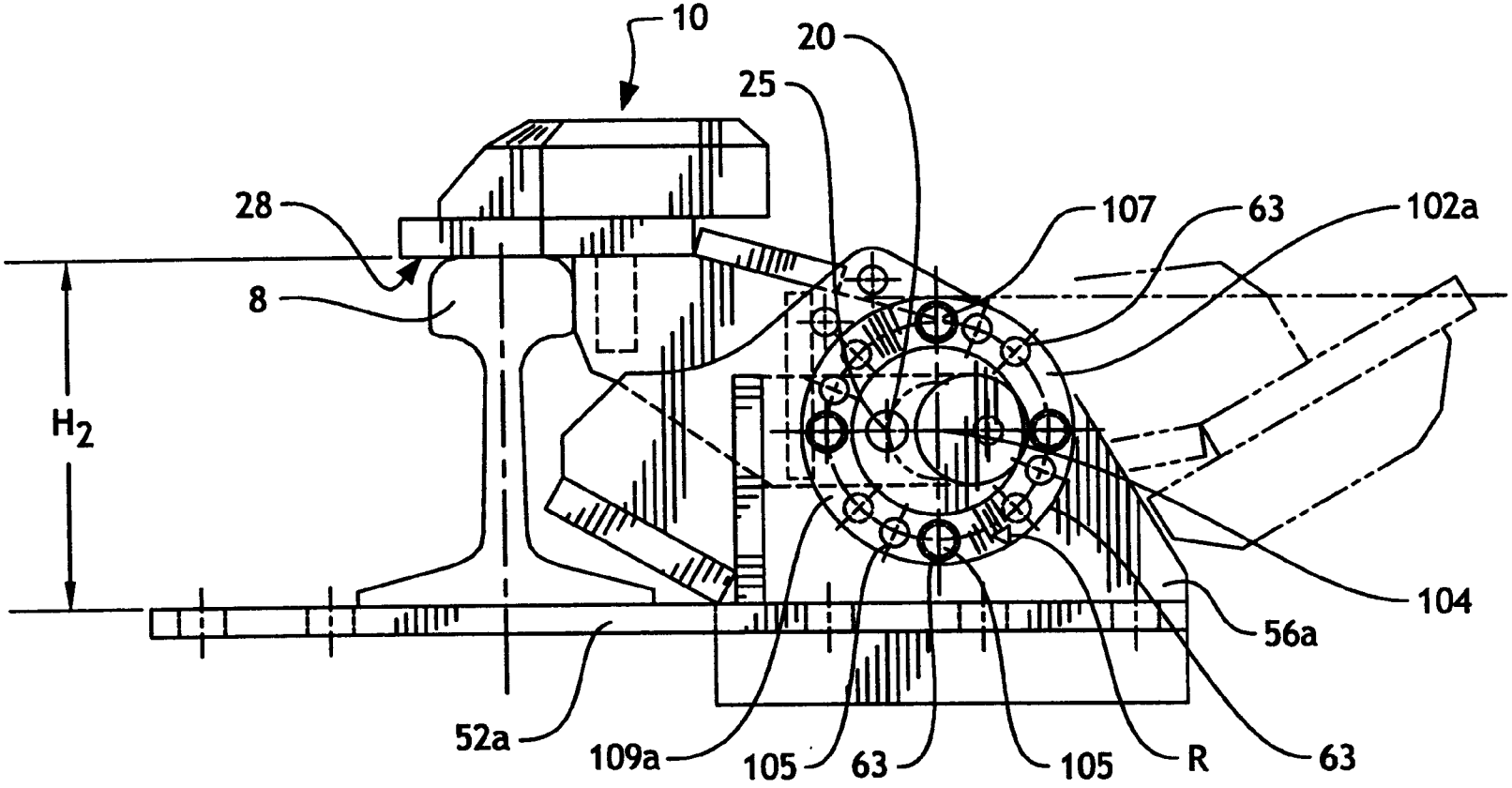
FIG. 5 is a side view an adjustable hinged derail according to a preferred embodiment of the present invention, the hinged derail being adjusted for an intermediate rail size.

Referring now to FIG. 5, a derailing device according to the aforementioned embodiment is shown adjusted for an intermediate rail height $H_2$. Adjustment has occurred by first removing the threaded fasteners 107 and rotating the adjustment flange 102*a* (and adjustment flange 102*b*) 90-degrees in a counterclockwise direction from the position shown in FIG. 3. Now, the hinge pin 20 and pivot axis 25 are disposed at an intermediate vertical position and reference indicator R is oriented approximately 190-degrees counterclockwise from vertical. Thus, the bottom surface 28 of deflecting block is aligned to rest substantially horizontally on the intermediate-sized rail 8.

Figure 6:
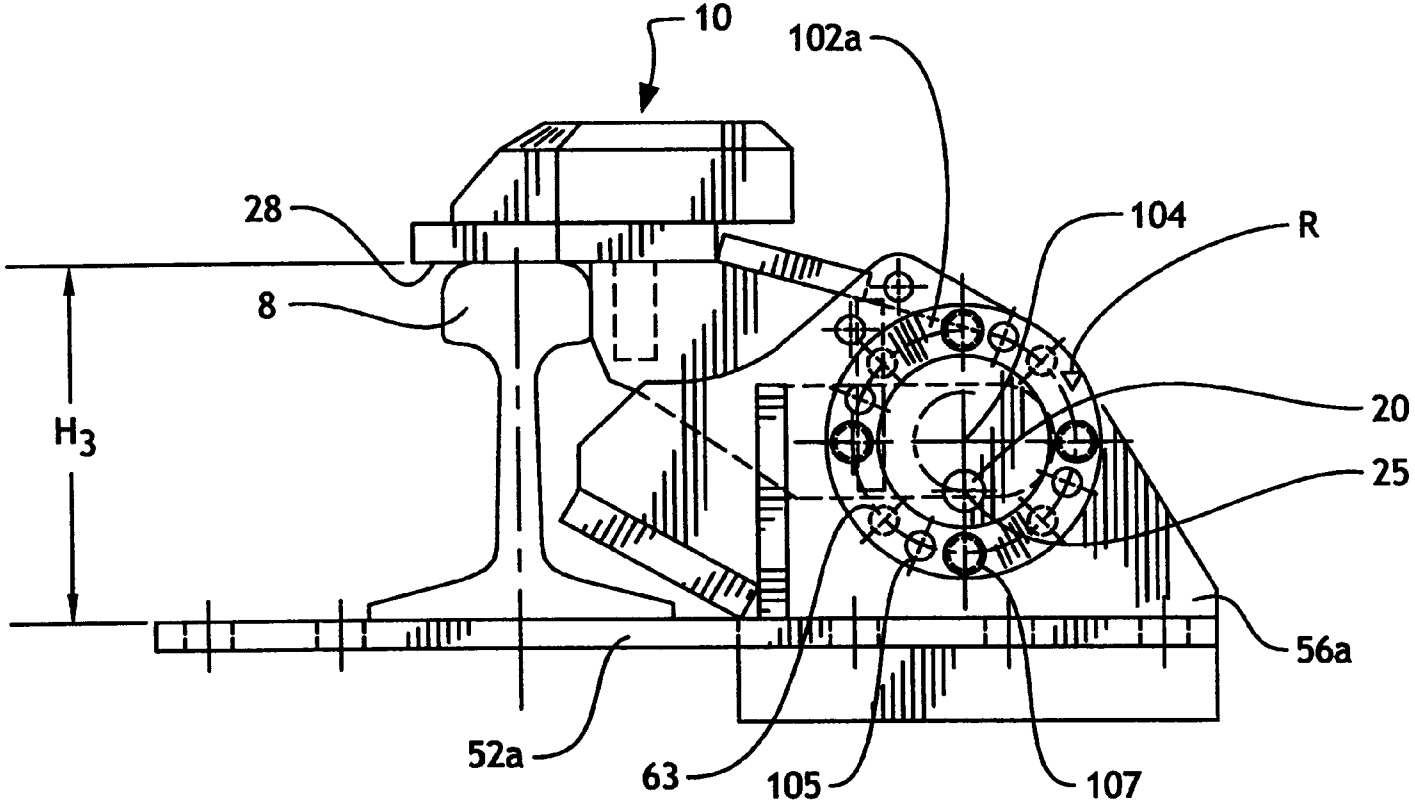
FIG. 6 is a side view an adjustable hinged derail according to a preferred embodiment of the present invention, the hinged derail being adjusted for an intermediate rail size.

Referring now to FIG. 6, a derailing device according to the aforementioned embodiment of the invention is adjusted for small rail height, $H_3$ by rotating the adjustment flanges 102*a* and 102*b* 90-degrees in a counterclockwise direction from the position shown in FIG. 5. Reference indicator R is now oriented at approximately 280-degrees counterclockwise from vertical. Again, the bottom surface 28 of the deflecting block is aligned to rest substantially horizontally on the small-sized rail 8.

It will be recognized that the horizontal position of the hinge pin 20 will change as the adjustment flanges 102*a* and 102*b* are rotated. It will be recognized that the base 50 will need to be shifted horizontally to maintain alignment of the deflecting block 12. For this reason, the mounting plates 52*a* and 52*b* are provided with an appropriate number and pattern of fastening holes 63 and the adjustment flanges are provided with an appropriate number and pattern of fastening holes 105 to provide for attachment of the mounting plates 52*a* and 52*b* to the rail supporting structure, i.e., railroad ties, to effect an appropriate number of different adjustment positions of the hinge pin 20 and to thereby provide for proper alignment of the deflecting block 12 with rails of different heights.

Figure 7:
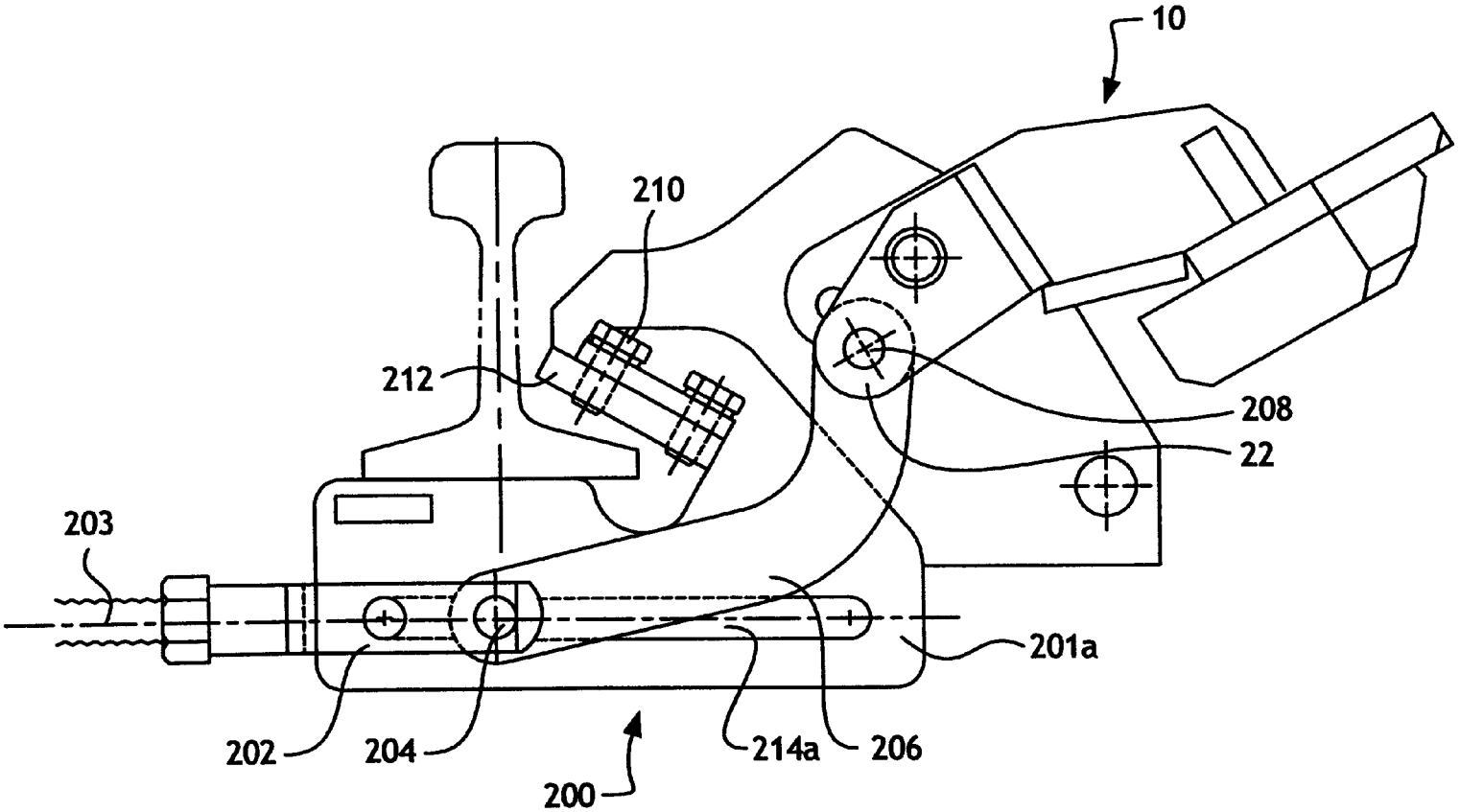
FIG. 7 is a side view of an adjustable hinged derail with an actuating linkage according to a preferred embodiment of the present invention.
Figure 8:
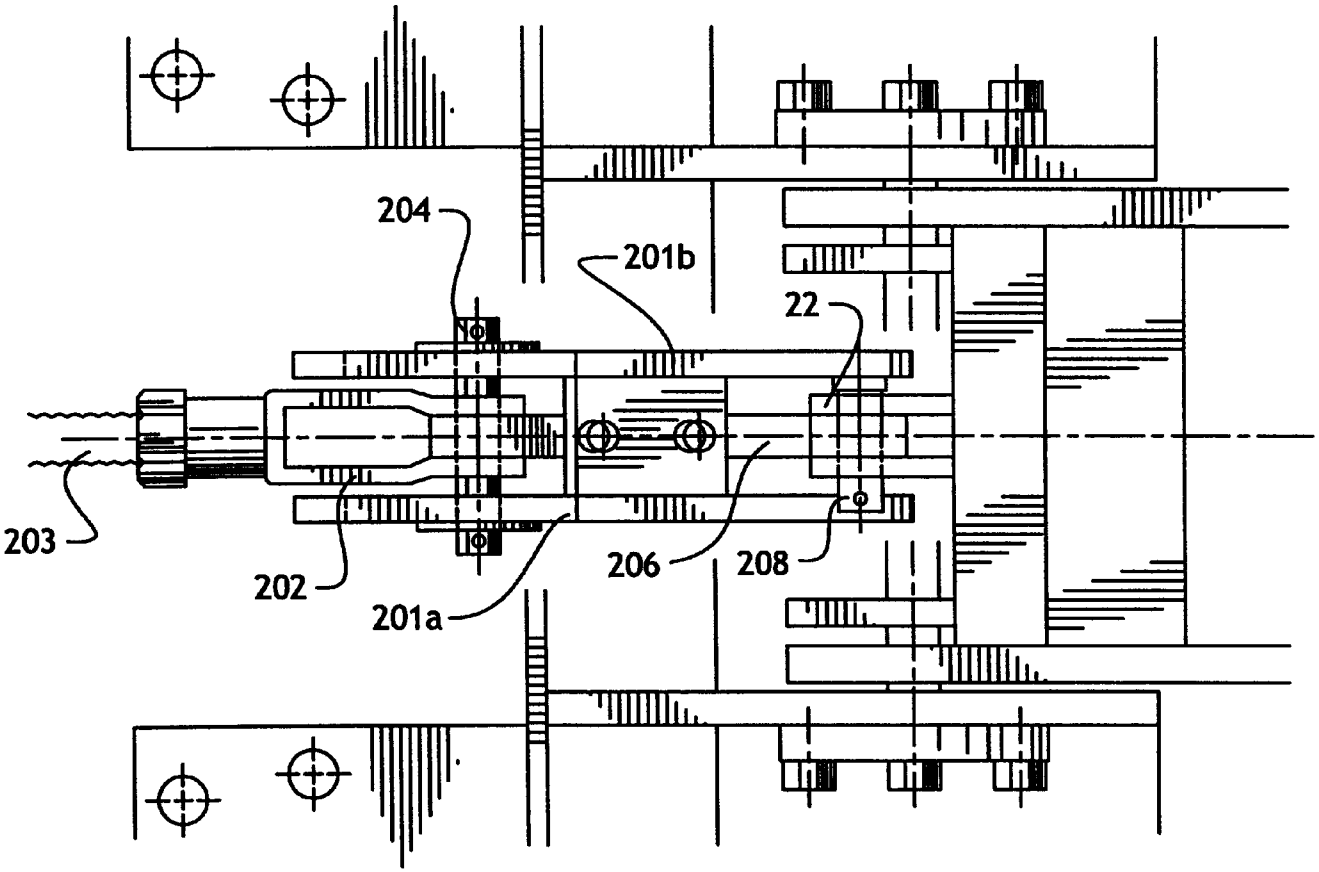
FIG. 8 is a top view of the actuating linkage of FIG. 7.

Referring now to FIGS. 7 and 8, the invention also contemplates an improved actuating assembly 200 for moving the derailing device from a deployed position to a retracted position. FIG. 7, for clarity, omits the aforementioned adjustment assembly 100. An actuating rod 203 is cooperatively associated with the actuating lug 22 and is threadably fastened to a clevis or yoke 202, which in turn is fastened to a connecting link 206 via a connecting pin 204. Connecting link 206 is, at an end opposite connecting pin 204, connected to the actuating lug 22 of the derail shoe 10 via an actuating pin 208. Actuating rod 203 is operated by a power actuator (not shown) for reciprocating movement in a horizontal direction. A pair of guide plates 201*a* and 201*b* are secured, via threaded fasteners 210, to angled members 212 of the base 50. Each guide plate 201*a* and 201*b* includes a guide slot 214*a* and 214*b* formed therein. Guide slots 214*a* and 214*b* slidably receive connecting pin 204 and guide it for horizontal movement as the derail shoe 10 is moved from its deployed position to its retracted position and back again.

The invention, as demonstrated in the preferred embodiment described above, provides an adjustable hinged derail which is easily configured for a number of different rail heights and which is provided with a dependable actuating assembly. Those skilled in the art will recognize that the preferred embodiments may be altered or amended without departing from the true spirit and scope of the invention, as defined in the accompanying claims. It will be appreciated by those of ordinary skill that other means for adjusting the position of the pivot axis of the derail shoe are contemplated by the present invention and are intended to fall within the scope of the claims that follow. Specifically, it is contemplated that non-rotary adjustment means may be provided, as in the form of member which is adjusted in a linear fashion, as opposed to rotary fashion, relative to the side plate. It is also contemplated that the rotary adjustment may be accomplished by other implements besides the adjustment flanges disclosed. For example, rotatable implements or flanges which are attached to the side plates via a frictional coupling, to permit fastening of the adjustment implements at an infinite number of rotatable positions are also contemplated.

What is claimed is:

1. A derailing device for use with a rail that can be a height of a plurality of different heights, the derailing device comprising:

a derail shoe including a deflecting block for deflecting an oncoming wheel of a rail vehicle;

a base for securing the derail shoe for movement relative to the rail, the deflecting block pivoting with respect to the base about a pivot axis;

pivot adjustment means for permitting adjustment of the position of the pivot axis relative to the base; and wherein the derail shoe is pivotally associated with the base through a hinge pin and wherein the pivot adjustment means comprises an adjustment flange for changing the position of the hinge pin, the adjustment flange adapted to be rotatable adjusted relative to the base about an adjusting axis adjacent to the pivot axis.

2. The derailing device according to claim 1, wherein the base includes a side plate having a journal formed therein, the adjustment flange adapted to rotate within the journal.

3. The derailing device according to claim 1, wherein the adjustment flange further includes a hole for receiving a fastener to secure the adjustment flange to the base in one of a plurality of rotated positions.

4. The derailing device according to claim 1, wherein the adjustment flange further comprises a plurality of through holes cooperating with at least a like plurality of holes in the base for receiving fasteners to secure the adjustment flange in one of a plurality of rotated positions.

5. The derailing device according to claim 1, wherein the base comprises a plurality of side plates that each comprise a plurality of holes, and wherein the adjustment flange further comprises a plurality of through holes cooperating with the plurality of holes in each side plate for receiving fasteners to secure the adjustment flange in one of a plurality of rotated positions.

6. The derailing device according to claim 1, further comprising an actuating assembly for moving the derail shoe from a deployed position to a retracted position, the actuating assembly including a connecting pin and a guide plate for guiding horizontal movement of the connecting pin.

7. A derailing device for use with a rail that can be a height of a plurality of different heights, comprising:

a derail shoe including deflecting block for engaging the wheel of a rail vehicle, the deflecting block including a bottom surface for engaging a top surface of the rail;

a base for securing the derail shoe for movement relative to the rail, the deflecting block pivoting with respect to the base about a pivot axis form a deployed position, in which the bottom surface engages the top surface of the rail, to a retracted position, in which the derail shoe is removed from the rail;

an adjustment assembly for permitting an operator to adjust the position of the pivot axis relative to the rail such that the bottom surface of the deflecting block may be selectively aligned with different sizes of rails; and wherein the derail shoe is pivotally associated with the base through a hinge pin and wherein adjustment assembly comprises an adjustment flange for changing the position of the hinge pin, the adjustment flange adapted to be rotatable adjusted relative to the base about an adjusting axis adjacent to the pivot axis.

8. The derailing device according to claim 7, wherein the adjustment assembly is adapted to permit the bottom surface of the deflecting block to remain substantially horizontal when engaging the top surface of rails of different heights.

9. The derailing device according to claim 8, wherein the base includes a side plate having a journal formed therein, the adjustment flange adapted to be rotated within the journal.

10. The derailing device according to claim 8, wherein the adjustment flange further comprises a through hole for receiving a fastener to secure the adjustment flange to the base in one of a plurality of rotated positions.

11. The derailing device according to claim 8, wherein the adjustment flange further comprises a plurality of through holes cooperating with at least a like plurality of holes in the base for receiving fasteners to secure the adjustment flange in one of a plurality of positions.

12. The derailing device according to claim 8, wherein the derail shoe is pivotally associated with the base through a hinge pin and wherein the pivot adjustment means comprises a pair of adjustment flanges disposed at opposite ends of the hinge pin for changing the position of the hinge pin, the adjustment flanges adapted to be rotatably adjusted relative to the base about an adjusting axis adjacent to the pivot axis.

13. The derailing device according to claim 8, further comprising an actuating assembly for moving the derail shoe from a deployed position to a retracted position, the actuating assembly including a connecting pin and a guide plate for guiding horizontal movement of the connecting pin.

14. A derailing device for use with a rail that can be a size of a plurality of different sizes, comprising:

a derail shoe including deflecting block for engaging a wheel of a rail vehicle, the deflecting block including a bottom surface for engaging a top surface of the rail;

a base for securing the derail shoe for movement relative to the rail, the base including a pair of mounting plates for securing the base to ties beneath the rail, each mounting plate being secured to a substantially perpendicular side plate extending therefrom, each side plate having formed therein a journal;

the derail shoe being pivotally associated with the base through a hinge pin to pivot about a pivot axis from a deployed position, in which the bottom surface engages the top surface of the rail, to a retracted position, in which the derail shoe is removed from the rail; and an adjustment assembly cooperating with the journals in the side plates, for permitting an operator to adjust the position of the pivot axis with respect to the rail.

* * * * *